United States Patent [19]

Georgitsis et al.

[11] Patent Number: 5,033,688

[45] Date of Patent: Jul. 23, 1991

[54] APPARATUS FOR A FLYING CHANGE-OVER FROM A FIRST DRUM TO A SECOND DRUM

[75] Inventors: Nikolaus Georgitsis, Zwingenberg; Gottfried Pusch; Miroslav Nitsch, both of Pfungstadt, all of Fed. Rep. of Germany

[73] Assignee: Tetra Pak Holdings & Finance S.A., Pully, Switzerland

[21] Appl. No.: 476,719

[22] Filed: Feb. 8, 1990

[30] Foreign Application Priority Data

Feb. 9, 1989 [DE] Fed. Rep. of Germany ..... 3903792

[51] Int. Cl.[5] ..... B65H 19/18; B65H 19/20

[52] U.S. Cl. ..... 242/58.1; 156/504

[58] Field of Search ..... 242/58.1, 58.3, 58.4; 156/502, 504

[56] References Cited

U.S. PATENT DOCUMENTS

| | | | |
|---|---|---|---|
| 3,886,031 | 5/1975 | Taitel | 242/58.4 X |
| 4,010,911 | 3/1977 | Heitmann | 242/58.4 |
| 4,172,564 | 10/1979 | Romagnoli | 242/58.3 |
| 4,390,388 | 6/1983 | Nagata et al. | 242/58.4 X |
| 4,676,447 | 6/1987 | Zald et al. | 242/58.4 |
| 4,722,489 | 2/1988 | Wommer | 242/58.4 |
| 4,738,739 | 4/1988 | Schoonderbeek | 242/58.4 X |

*Primary Examiner*—John M. Jillions

*Attorney, Agent, or Firm*—Burns, Doane, Swecker & Mathis

[57] ABSTRACT

An apparatus for a flying change-over of a synthetic plastics strip (13, 13') from a first drum with a roll (3, 3') of this strip to a second drum carrying a roll (3, 3') of the same synthetic plastics strip (13, 13') has, in addition to the two drums, a cutting (9, 9') and gluing (5) means as well as control means (6) for actuating the various drives.

To reduce the number of packages which are wasted in the package production machine, even though the production machine continues to operate even while the drums are being changed, it is according to the invention envisaged that direction-changing (15, 16, 18, 21), guide (8, 8') and pressure-applying rollers (7, 7') should be adjustably disposed and symmetrical in relation to a central line m which extends at right-angles to the connecting line v between the axes (4, 4') of the two rolls (3, 3'), and in that in each case one pressure-applying roller (7, 7') is adjustable in relation to the other and in that the adjusting drive (31, 31') for this can be controlled by a switch (10, 10') which is actuated as a function of the position of a roll sensing roller (26, 26').

11 Claims, 5 Drawing Sheets

APPARATUS FOR A FLYING CHANGE-OVER FROM A FIRST DRUM TO A SECOND DRUM

The invention relates to an apparatus for a flying change-over from a first drum carrying a roll of synthetic plastics strip to a second drum carrying a roll of the same synthetic plastics strip in which, in addition to the two drums, a cutting and gluing means as well as control means for actuating the various drives are provided.

The use of the apparatus described here is intended for machines for manufacturing packages to hold flowable media, to be produced from paper material coated on both sides in fluid-tight manner with synthetic plastics material. Parallelepiped packages of this material are already known in the distribution of milk and juices. To overcome the problems connected with mass production, many types of package are produced from a tube, the individual packages being produced from the tube by a transverse sealing stage. Inter alia, these prior art packages comprise a longitudinal sealing seam produced, for instance, by overlapping one edge of the tubularly shaped strip over the other terminal edge, the area of overlap being then sealed.

A man skilled in the art knows that in fact in the region of a sealing seam formed by overlapping the terminal edges, one cut edge of the strip will finish up in the inside of the package. The cutting produces an edge which is not covered with synthetic plastics material and into which liquid can penetrate, possibly destroying the package at this point. It is therefore already known, too, continuously to lay a covering strip over this plastics-free edge while the package is being produced. The material used for such a prior art synthetic plastics strip is, for example, polyethylene. In practice it has been found convenient for this polyethylene strip to be made about 6 mm wide and to weld it onto the sealing seam in this form, the serve as an edge protection.

The man skilled in the art is therefore faced with the problem of continuously feeding to the package producing machine a synthetic plastics strip of, for instance, 6 mm width, so that the process of package production can be continuous. In this respect it is, of course, already known for such synthetic plastics strips to be produced separately and to be wound onto the hub of drum to form a relatively large quantity and to be stored in this form. The appropriate drum is placed in an apparatus upstream of the package producing machine, the start of the synthetic plastics strip is taken from the roll, introduced into the manufacturing machine and then operation can commence.

However, it always become problematical if a first roll was largely consumed so that the first drum became empty because a relatively long distance and a relatively large quantity of packages would continue to be continuously produced in which, before the start of the synthetic plastics strip on the second complete drum could be introduced, packages would be turned out which had no edge protection because it was not possible to supply a synthetic plastics strip. Therefore, consideration has been given to the question of how it would be possible to switch over from a first roll of synthetic plastics strip to a second roll of the same synthetic plastics strip in the shortest possible time.

Therefore, the invention is based on the problem of developing an apparatus for a flying change-over from a first drum carrying a roll of synthetic plastics strip to a second drum so that the wastage of packages in the package production machine is reduced even though the production machine continues to operate even during the change-over of drum or roll.

In the case of an apparatus of the type described at the outset, in which, in addition to the two drums, a cutting and a gluing means as well as control means for actuating the various drives are provided, this problem is resolved in that direction reversing, guide and pressure-applying rollers are disposed adjustably and symmetrically of a central line which extends at right-angles to the line connecting the axes of the two rolls and in that in each case one pressure-applying roller is adjustable in relation to the others and in that the adjusting drive for this can be controlled by a switch which is actuated as a function of the position of a roll sensing roller. The change-over apparatus according to the invention therefore works from a first drum carrying a first rol to a second drum carrying a second roll, the drums being disposed at a distance from each other, and whereby at right-angles to a line connecting the drum axes which are equivalent to the roll axes, there is an imaginary central line in respect of which parts such as, for example, direction reversing rollers, guide rollers and pressure-applying rollers are disposed in a symmetrical relationship. While it is known per se for strips such as, for example, the synthetic plastics strip being processed here, to be guided over direction changing and guide rollers, according to the invention there are in addition provided, symmetrically with whichever is the other side, respective pressure-applying rollers, whichever roller happens to be opposite the adjusted pressure-applying roller always serving as a mating roller. Pressure is applied to the two synthetic plastics strips in response to a control command which, in a manner as yet to be described, is given at exactly that moment when the first roll is almost at its end and the start of the second roll has been threaded in through that of the two pressure-applying rollers which at that moment does not happen to be passing the strip from the working roll, namely the first roll which is just coming to an end.

According to the invention, it is also envisaged that at the start of the second complete roll, which so to speak represents the replacement roll, a portion far beyond a length of, for example 1 to 8 cm, preferably 2 to 6 and particularly preferably 4 cm, a strip of adhesive carrying an adhesive coating is placed on both flat surfaces. Therefore, during operation, if the working roll is observed and is gradually approaching the end of its stock, then it can be seen how this strip extends over one of the two pressure-applying rollers which is preferably driven without contacting the other second and non-driven stationary driving rollers. Between the mutually facing locations on the surfaces of the two driving rollers there is in continuous operation a distance which is generally and preferably between 3 and 10 mm, the preferred gap being 6 mm. On the oppositely disposed second drive roller is the commencement of the strip which is the replacement roll and which is so to speak situated ready for use on the second drive roller.

The aforementioned roll sensing roller according to the invention, as its name states, senses the periphery of the roller and varies its position during the course of operation until, when the first roll has almost come to an end, the said switch is operated and inter alia acts upon the adjusting drive for the pressure-applying roller. At the moment of the control pulse, therefore, the stationary pressure-applying roller with the adhesive strip clinging to it is pressed onto the oppositely disposed rotating pressure-applying roller so that the start of the strip on the replacement roll is glued to the end of the strip on the working roll.

It is possible to appreciate the great advantage that as with a flying change-over the synthetic plastics strip can run continuously over this point of adhesion because the first roll is now empty so that the continuing feed of the further synthetic plastics strip comes from the replacement roll which now becomes the working roll.

It is particularly favourable in this respect if, according to the invention, the gluing means with the pressure-applying rollers also comprises a cutting means so that at the moment when pressure is applied by the second pressure-applying roller on the replacement side, on the working side the strip passing through is cut against the direction of feed of the strip at a short distance from the location which at that moment happens to be between the pressure-applying rollers which have just been in contact. This distance between the said location between the pressure-applying rollers on the one hand and the cutting point in the direction against the direction of movement of the strip on the other amounts to 2 to 15 cm, preferably 30 to 100 mm and especially preferably 70 mm.

By reason of this disposition of cutting device in respect of the gluing means, in other words in respect of the cut engagement point in relation to the pressure-applying roller gap, an advantageous consequence is that in the direction of travel of the strip, after the gluing point, only about 2 to 5 cm of old synthetic plastics strip from the first working roll which is just coming to its end runs in together with the start of the new second roll. In this so-called gluing zone, and only in this zone, the two synthetic plastics strips travel in a superposed relationship. The gluing zone can be made very short by an appropriate disposition of the cutting means in respect of the gluing means. An advantageous outcome of this is that, in spite of the flying change-over from the first roll to the second roll, so little "edge protective strip" leads to rejects in the package production machine that only one or two packages will finish up being provided with a duplicated portion of adhesive strip which might jeopardise sealing-tightness.

Therefore, it is particularly advantageous if the pulse which triggers the adjusting drive for the pressure-applying rollers simultaneously sets the activity of the cutting means in motion.

Furthermore, it is particularly favourable if according to the invention this pulse which is triggered by the switch also gives the package production machine the command to reject, for example, a specific group of packages because it can be assumed that the adhesive strip is disposed in this group of packages. In practice, it has been shown that it maybe sufficient to eject just one single package. On grounds of safety and sealing-tightness, however, it is preferably to reject three to four packages because it is then possible, for constant operation of a milk packaging plant, to guarantee that the gluing point is among the rejects.

There is no need to describe here in particular detail that, in a manner which is known per se by a man skilled in the art, the group of packages which are rejected can be accurately determined in the constantly running production line, because the production speed is preset and therefore the distance between the glued part which runs in with the synthetic plastics strip and the package on which the synthetic plastics strip is applied with this glued portion, is accurately established.

Therefore, the package production machine can be operated continuously, can continuously feed a synthetic plastics edge protective strip, even if a first supply drum carrying synthetics plastics strip runs empty after prolonged operation and is replaced by a second drum.

In an advantageous further development of the invention, the roll sensing roller which is adapted to be guided along the periphery of the roll is rotatably mounted on a sensing arm disposed symmetrically of the central line in respect of whichever happens to be the other sensing arm, the relevant sensing arm being mounted on an articulating block which is pivotable about an axis parallel with the axis of the roll and carrying a switching block to actuate the switch. In this way, the machine can be made particularly robust and reliable because for each drum on the relevant side of the said central line there is a sensing arm with a roller and a control device. The control is effected by the angular position of the scanning arm which is horizontal, for example, at the start when the roll is full and passes through an angle of, for example, 45° by the time the final position is reached. By reason of the construction according to the invention, therefore, the articulating block has pivoted likewise through 45° about its axis so that the switching block entrained by it, having traversed the arc of the angle, moves into the region of the switch and actuates it. In this respect, it is particularly advantageous if the switching block is adjustable in relation to the articulating block because it is possible in this way to make an adjustment to suit the individual sizes of drum.

According to the invention, it is furthermore particularly advantageous if the hub of the drums, the spindles of the articulating blocks, the switch and the gluing means are mounted on one main plate. Although these parts are disposed symmetrically of the said central line and are thus paired off, a disposition on a main plate is according to the invention envisaged to provide for ready possibility of production and also easier handling, particularly if according to the invention the main plate is pivotable in relation to the package production machine. If, during the course of operation or even during shut-down times, staff wish to carry out maintenance or repairs, then without dismantling the apparatus for the flying change-over it is according to the invention easily possible to swing the main plate up from the frame of the machine and the parts installed behind this plate are readily accessible.

According to the invention, it is expedient if at least one direction reversing roller is constructed as a jockey roller. The transverse seal which is made through the tube in the package production machine results in an intermittent operation so that also the synthetic plastics strip is pulled into the production machine intermittently from the supply. According to the invention, the jockey roller can establish a compensation between continuous and intermittent With this or even with an additional jockey roller of a different type, it is possible to ensure continuous maintenance of a web of synthetic plastics strip which is guided with moderate tension if the jockey roller is combined with a brake so that when the synthetic plastics strip is pulled taut, i.e. when there is an increase in the tension in the strip being delivered, the brake can be somewhat slackened. According to the invention, this is achieved in that the jockey roller and the brake are connected to each other by a one-piece support which is in turn pivotable through relatively small angles.

In an advantageous further development of the invention, a brake constructed as a steel bracket bent to a V-shape is connected to the arm of the jockey roller and can be brought into engagement with a side plate of the drum. Such a V-shaped brake bracket cannot only be produced easily and inexpensively but it can also be easily mounted at one end of an angled-over double arm, while the jockey roller is rotatably disposed at the opposite end of the double arm and there can be a rotary mounting disposed in the centre where the two arms converge. In this way and in the manner described above, the V-shaped bracket follows the movement of the jockey roller. This development and disposition of the brake are advantageous because the side plate of the drum does not change during operation. The diameter of the drum remains the same despite rotation of the drum and despite the reduction in the size of the roll on the drum. For one and the same position of the jockey roller and thus also of the brake, therefore, the braking action on the drum always remains the same.

According to the invention, it is furthermore advantageous if, viewed in the direction of travel of the synthetic plastics strip, a switch-off safety device is provided after the gluing means. Therefore, if for any reason the tension in the synthetic plastics strip should fall too greatly on the delivery side, then this safety device will shut down the relevant strip drive in order advantageously to prevent breakdowns. This switch-off safety device can according to the invention and in a particularly advantageous manner be so developed that a roller having a certain weight is disposed between two direction reversing rollers in such a way that the roller is carried by the moving plastics strip. If the tension in the plastics strip falls very markedly or even tears the strip, then this roller falls down and thus actuates a switch to break a drive circuit. This switch and also the above-mentioned may be microswitches, preferably proximity switches. By means of a switching lug, proximity may be provided for or cancelled out so that one or other state of the switch is achieved. If the aforesaid roller is rotatable about an axis and via a pivotable arm, then its rotary movement is a circle. The switching lug connected to this roller to serve as a switch-off safety device can according to the invention also be of arcuate construction so that a switching lug is provided which resembles part of the shell of a cylinder and which ensures that the relevant proximity switch is switched on or off, as required. In fact, during constant operation, the roller can rest with a certain amplitude on the synthetic plastics strip which passes under the roller and with it, the switching lug which is of elongated construction in the direction of movement, so that the proximity switch really only switches off when the roller acting as a switch-off safety device has passed through a relatively considerable amplitude of movement.

Further advantages, features and possible applications of the present invention will emerge from the ensuing description of preferred examples of embodiment which are illustrated in the accompanying drawings, in which.

Figure 1:
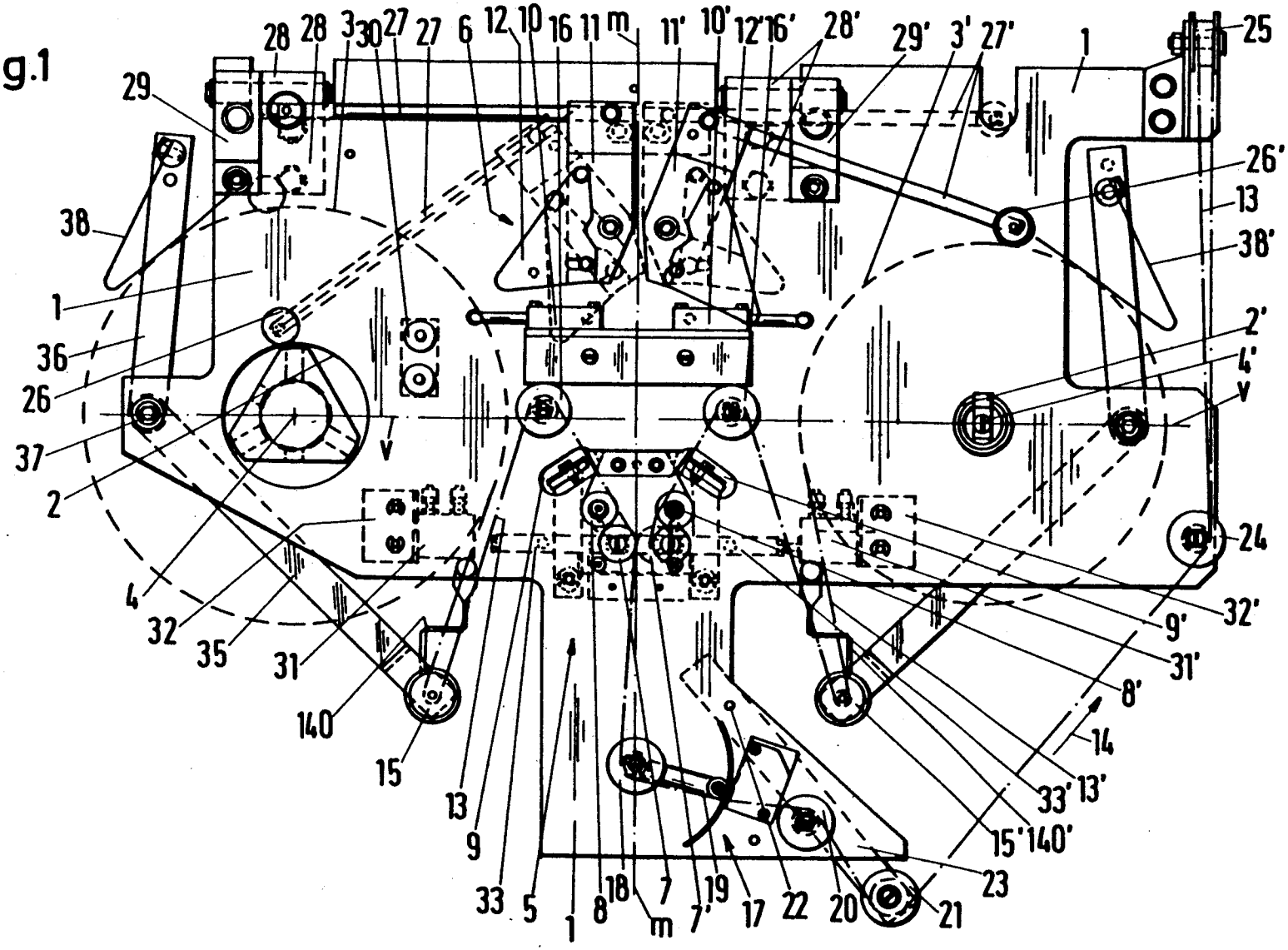
FIG. 1 is a plan view of the main plate with the two rolls and the entire apparatus for a flying change-over from one roll to the other.

FIG. 1 shows an overall view of the apparatus described here in the preferred embodiment which is shown in the drawings. On a main plate 1 with its central line m there are symmetrically disposed: on the left the hub 2 of a first drum not shown but carrying the first roll 3 and on the right, in a symmetrical relationship, the differently constructed hub 2' of the second roll 3' which are carried on spindles 4, 4' which project at right-angles from the plane of the drawing and thus also at right-angles from the main plate 1. The broken line v connects the spindles 4 and 4' of the rolls 3 and 3' and is the connecting line. The distance between the spindles 4 and 4' is so great that even between the full rolls 3 and 3', there is still sufficient space for a gluing means generally designated 5 in the area substantially below the connecting line v and for a control means generally designated 6 and disposed in the region above the connecting line v.

Figure 2:
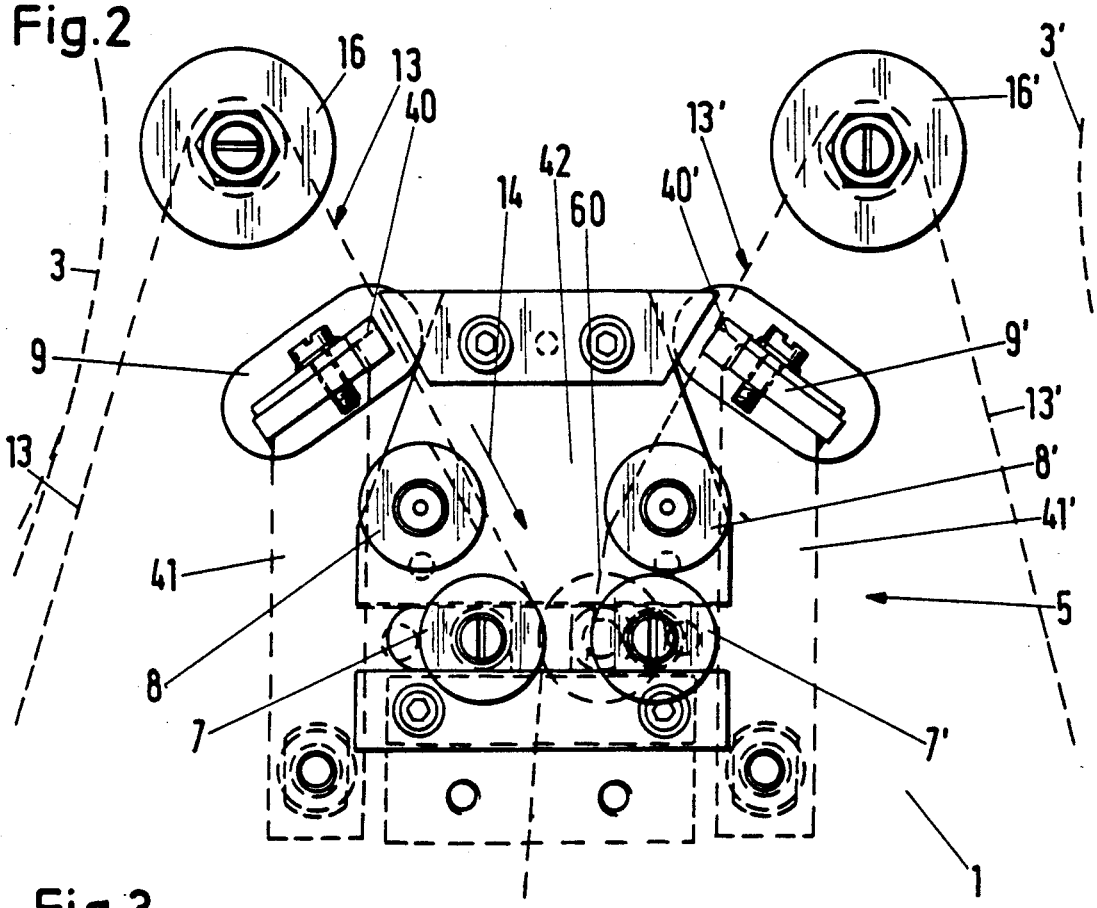
FIG. 2 is a detailed view of the gluing means and cutting means in plan, looking down onto the main plate as in FIG. 1.
Figure 3:
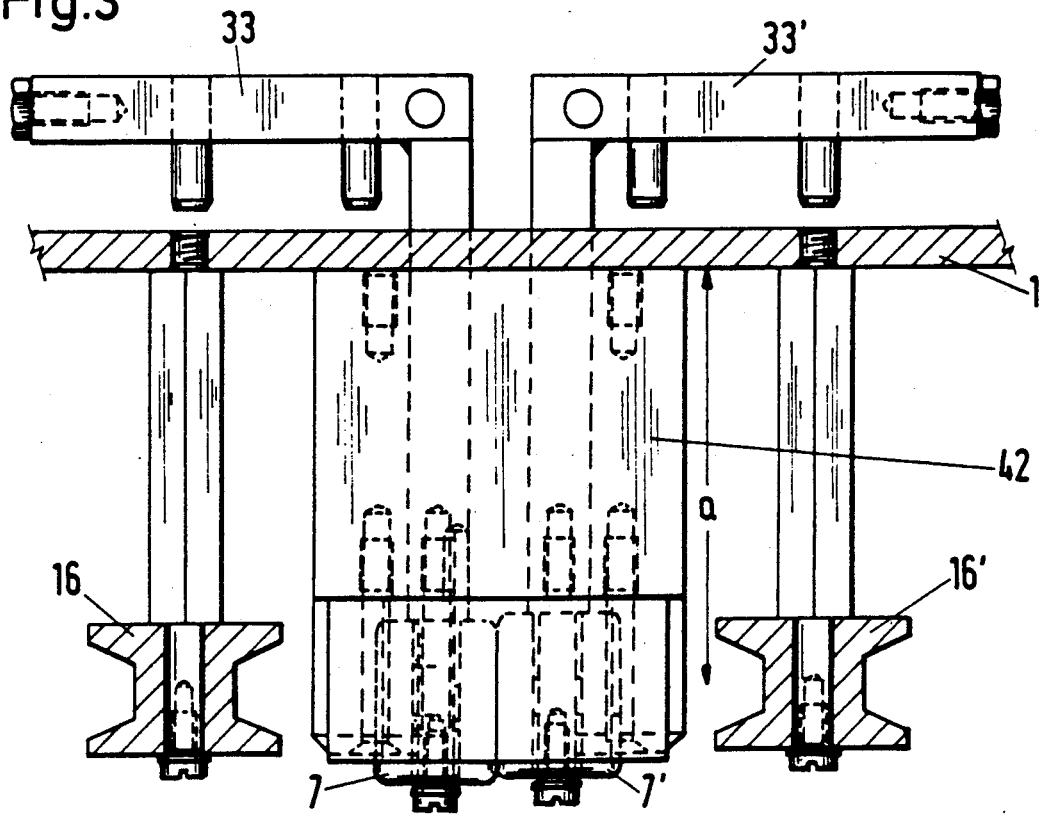
FIG. 3 is a plan view of FIG. 2 viewed from above and in the direction of the plane of the main plate.

The gluing device 5 is shown in greater detail in FIGS. 2 and 3 and consists of the pressure-applying rollers 7, 7', the guide rollers 8, 8' and the cutting means 9, 9'. The control means 6 shown in greater detail in FIGS. 6 and 7 comprise essentially the microswitches 10, 10', the articulating blocks 11, 11' and the switching blocks 12, 12' which are mounted thereon.

Indicated by broken lines are the synthetic plastics strips 13, 13', of which the first synthetic plastics strip 13 is moved in a direction from the side described as the working roll 3 in FIG. 1 while the second synthetic plastics strip 13' is indeed shown in the threaded-on position but, according to FIG. 1, comes from the replacement roll 3'. It can be seen how in the operating condition shown, the synthetic plastics strip 13 is being pulled off the first left-hand roll 3 around the direction-reversing roller 15 which is constructed and mounted as a jockey roller, being pulled first downwardly and then guided upwardly again being supported by a second direction-reversing roller 16 and then downwardly past the cutting means 9, through the guide roller 8 and past the the driven pressure-applying roller 7, when it is then inserted into the switch-off safety device generally designated 17. This latter is shown more clearly and on an enlarged scale in FIGS. 4 and 5.

In a region of this switch-off safety device 17, the synthetic plastics strip 13 is first looped around the direction-reversing roller 18, passes under the switching roller 19, is looped from above downwardly around the other direction-reversing roller 20 followed by the direction reversing roller 21 which is rotatable on an arm 23 pivotable about the axis 22 (jockey roller), whereupon it runs obliquely upwardly in the direction 14 to the two direction reversing rollers 24 and 25.

The second synthetic plastics strip 13' which is initially held in a stand-by position runs similarly off the roll 3', is looped around the direction reversing roller 15' which is constructed as a jockey roller, and then around the direction reversing roller 16' and then runs symmetrically in relation to the strip 13 and in respect of the middle line m past the cutting device 9' over the guide roller 8' to cling to the pressure-applying roller 7' which has stopped at a distance from the pressure-applying roller 7.

Figure 6:
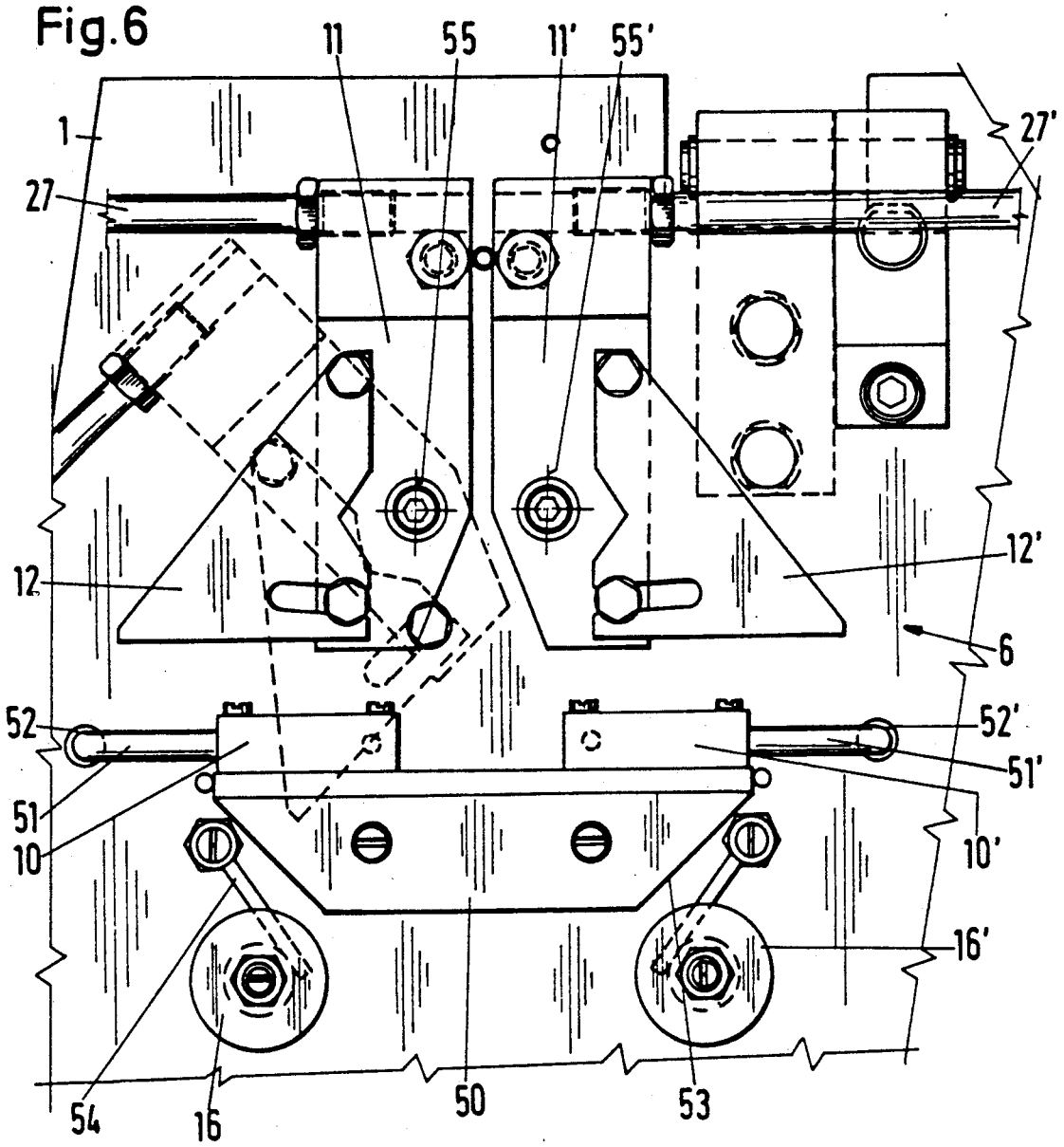
FIG. 6 is a detailed view of the apparatus shown in FIG. 1 showing the articulating blocks, the switching blocks and the microswitches.

The periphery of the relevant roll 3 is sensed by a roll sensing roller 26 on one side or on the opposite side 26'. The roll sensing roller 26 is rotatably mounted on a sensing arm 27 or 27' which is connected to the aforementioned articulating block 11 or 11' by clamping and bolting. In FIG. 1 and shown in a partially broken away view in FIG. 6 is the sensing arm 27 (27') which is shown in a solid line and also in another partially broken line position, the broken line position of the sensing arm 27 which is shown on the left-hand side of FIG. 1 having passed through a greater angle of, for instance, 45° than the right-hand sensing arm 27' which, in order to achieve the position shown by solid lines, will have passed through an angle of only about 25° to 30° in respect of the horizontal position which is shown in broken lines on the right-hand side.

FIG. 1 also shows the pivot bearings 28, 28' and 29, 29' which are provided on the machine frame (28, 28') or on the main plate (29, 29') so that the main plate 1 is able to pivot about these bearings 28, 29 over the machine frame, not shown. This pivoting movement can be assisted by a pneumatic spring, not shown, but which is connected to the main plate 1 at the location identified by reference numeral 30 on the left in FIG. 1.

FIG. 1 furthermore shows the adjusting drive in the form of the two pneumatic short-travel cylinders 31, 31' which are mounted on the main plate 1 by the mounting members 32, 32' and which operate movable levers 33, 33' and which move in the longitudinal direction of these levers 33, 33' on the ends of which opposite the cylinders 31, 31' the respective pressure-applying rollers 7, 7' are rotatably disposed. FIG. 3 shows that the movable levers 33, 33' are on the upper (rear) side of the main plate 1, while the pressure-applying rollers 7, 7' are on the front face, also the synthetic plastics strip 13, 13' passing over the direction-reversing rollers 16, 16' at this point. FIG. 3 also shows the gap a over which the strip 13 or 13' runs from the main plate 1. As seen in FIG. 1, this distance extends in the direction of view of the paper plane, i.e. the direction-reversing rollers 16, 16' are at a distance a in front of the main plate 1.

This provides space for disposition of the individual parts of the control means, generally designated 6.

FIG. 1 furthermore shows, constructed as a jockey roller, the direction-changing roller 15 (only the left-hand side is described), which is rotatably mounted on a lever 35 with which in turn a second lever 36 is connected at an angle, in other words the two consisting of one piece and being pivotable in both directions about a common axis 37 at their inner end. At their outer ends, therefore, on the already described lever 35, the direction-reversing roller 15 is mounted, while mounted on the other lever 36 is a brake 38 which is constructed as a steel bracket which is bent to a V-shape.

Figure 8:
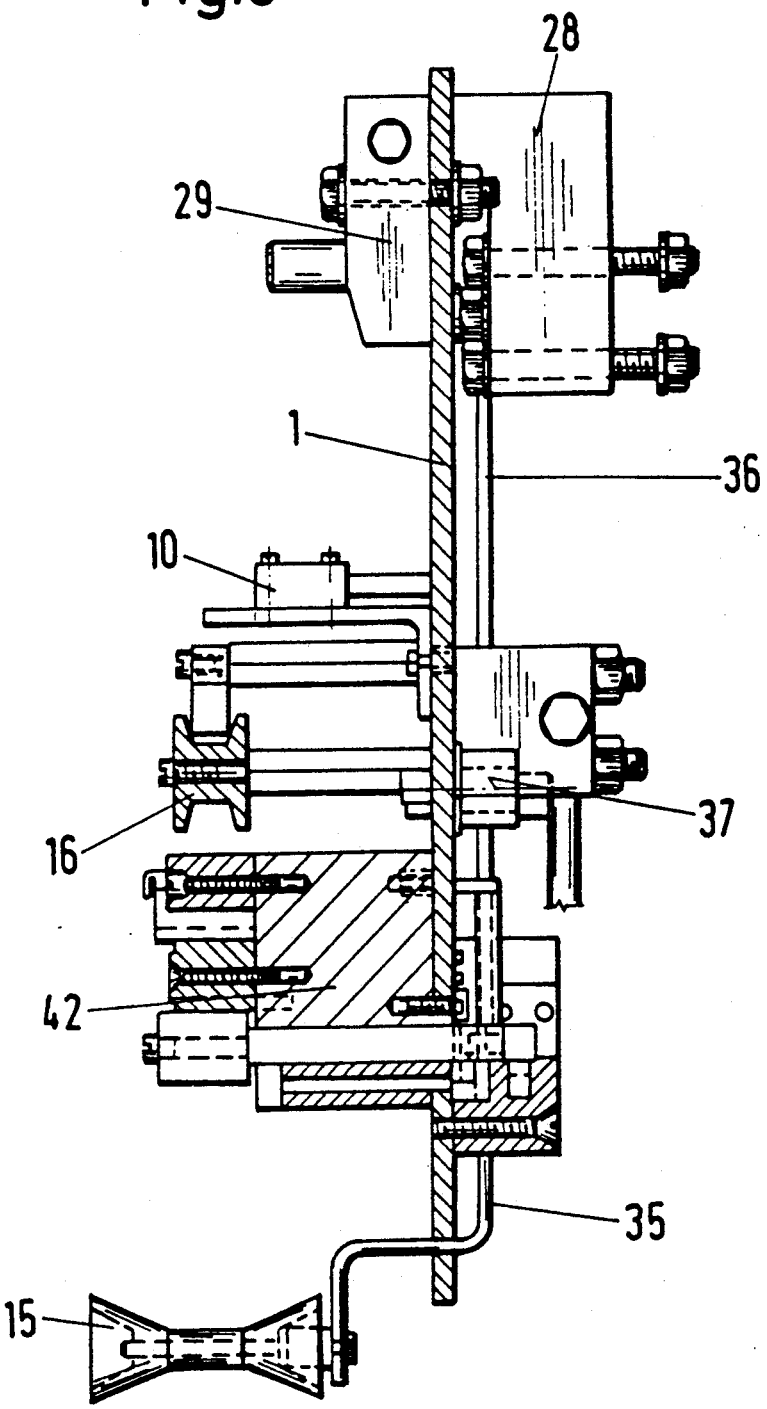
FIG. 8 is a sectional view through the main plate substantially along the middle line m in FIG. 1 but without the switch-off safety device and without the articulating blocks.

The direction-reversing roller 15 at the end of the first lever 35, the configuration of which can also be seen in cross-section in FIG. 8 can, as FIG. 1 shows, run up against a Z-shaped bracket 140 which ensures that the lever 35 cannot be further rotated in an anti-clockwise direction about the pivot point 37 but is arrested in the position shown in FIG. 1. Whichever is the bottom arm of the V-shaped brake 38 runs against the plate (not shown) beside the roll 3 and is more or less intensely engaged continuously with its periphery. FIG. 1 shows the brake 38 in the position it would adopt if it were tangentially resting on the periphery of the roll 3. In actual fact, it does not engage the roll 3 but the disc of the drum. Naturally, the same also applies to the other brake 38'.

FIG. 2 shows the gluing device generally designated 5 in a frontal view, while FIG. 3 shows it in a plan view on an enlarged scale by way of clarification. In the direction of travel 14 of the synthetic plastics strip 13, there is after the upper direction-reversing roller 16 a cutting blade 40 (or on the right 40') of the cutting means 9 or 9' with the mounting 41, 41' for the cutting means 9, 9', which is so provided that when the pressure-applying roller 7' moves out of the position shown by solid lines in FIG. 2 into the position shown by broken lines on the left, in which pressure is applied, also the cutting means 9 comes into action. Corresponding block units 42 provide for suitable mounting of the rollers 7, 8 and the like.

Figure 4:
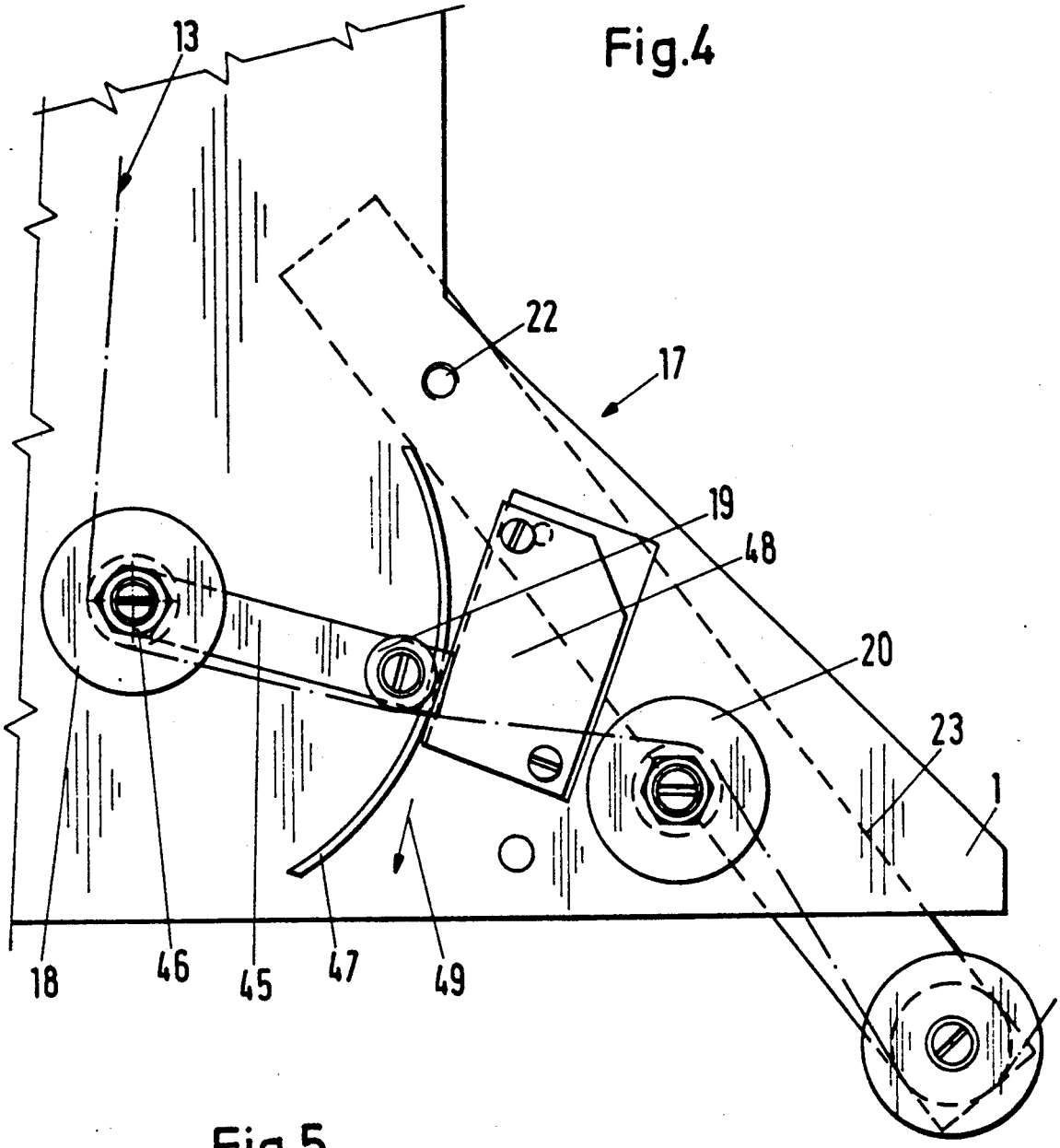
FIG. 4 shows the switch-off safety device in the plan view in FIGS. 1 and 2.
Figure 5:
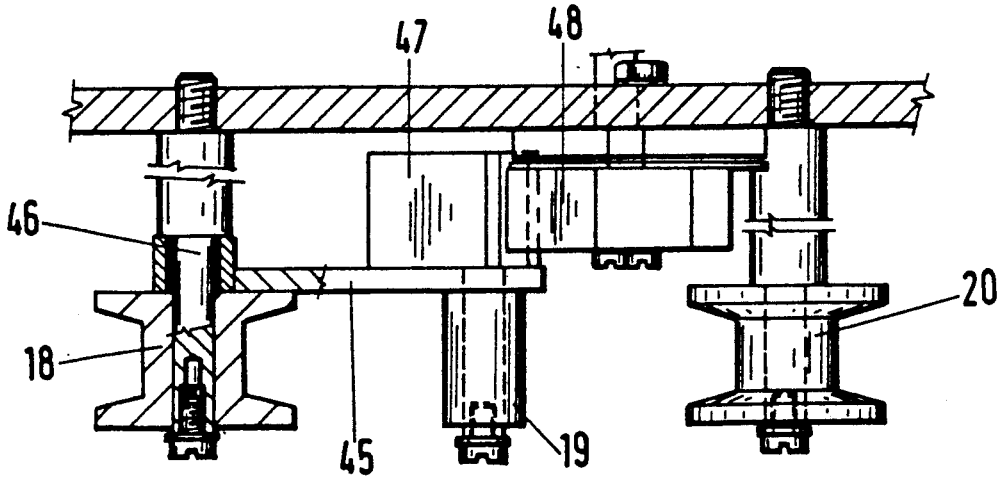
FIG. 5 is a plan view of the switch-off safety device looking downwards in FIG. 4, in other words again in the direction of view of the plane of the main plate.

The switch-off safety device 17 is shown in FIGS. 4 and 5. The switching roller 19 is mounted on an arm 45 so that it can rotate about the axis 46, in fact regardless of the mounting of the direction-changing roller 18 which has the same axis of rotation 46. Mounted on this arm 45 is the switching lug 47 which is in the shape of part of a cylindrical shell which functionally engages the proximity switch 48 and so triggers its switching function. If, in fact, the strip 13 shown in FIG. 4 should tear, then the switching roller 19 with the switching lug 47 will drop in the direction indicated by the arrow 49, the switching lug 47 will remove itself from the effective zone of the proximity switch 48, which thus opens the drive circuit and shuts down the drives.

Figure 7:
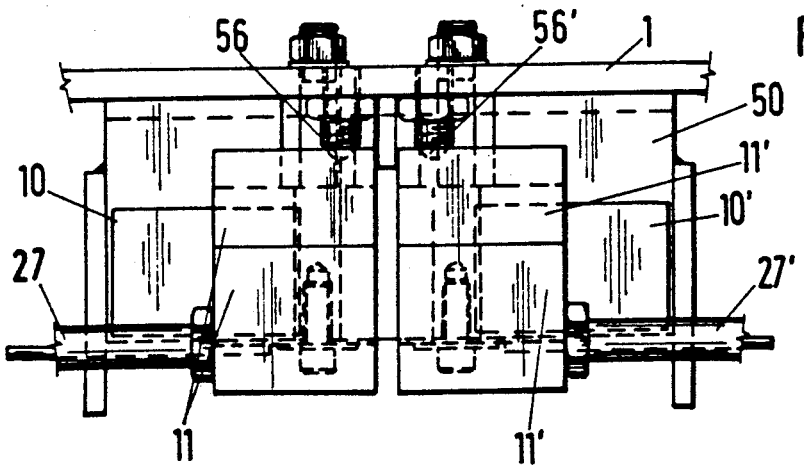
FIG. 7 is a view of the parts shown in FIG. 6 but looking downwards in FIG. 6, in other words in the direction of the plane of the main plate.

The control means 6 is shown in FIGS. 6 and 7, in this case the retaining member 50 for the proximity switches 10, 10' with their cables 51, 51' which are guided through the holes 52, 52' in the main plate 1 to behind the plate, is provided with a sloping surface 53 as compared with the view in FIG. 1 so that a gravity operated flap 54 can be provided which is urged by gravity onto the synthetic plastic strip (not shown in FIG. 6) on top of the direction-reversing roller 16 and which is intended to prevent the synthetic plastics strip not shown in FIG. 6 from falling out due to movements, wind or the like.

The articulating blocks 11, 11' are pivotable about the axes 55, 55', and in order to change the drums the horizontal position of the spacer arms 27, 27' is desired and can be established by a spring loaded ball locking means, as indicated at 56, 56' in FIG. 7. In operation, the apparatus according to the invention works so that, starting from the situation shown in FIG. 1, the synthetic plastics strip 13 is in the manner described and illustrated above moved in the direction of travel 14 and, due to the distance between the pressure-applying rollers 7 and 7', it is in contact with the left-hand pressure-applying roller 7. When the sensing arm 27 has run down substantially to the hub 2 of the drum or to the last few turns of the first roll 3, the switching lug 10 will have reached the position shown by broken lines on the left in FIG. 1 and will have actuated the proximity switch 10 in such a way that it emits an electrical pulse. This pulse controls the pneumatic short travel cylinder 31' so that the pressure-applying roller 7' with the start of the strip and with the adhesive strip 60, as shown by the thick line on the right in FIG. 2, is pressed onto the oppositely disposed moving strip 13. The electrical pulse also triggers the cutting of the strip 13 by the left-hand cutting device 9 so that only one length of strip of the first synthetic plastics strip 13 continues to pass between these points jointly with the new strip 13'. These two points are, on the one hand, the point of contact between the two pressure-applying rollers 7, 7' in the pressed-together state and, on the other, the point of engagement of the cutter 40 of the cutting means 9 during cutting of the strip 13.

Afterwards, the sensing arm 27 is pivoted into the horizontal position in which it is arrested, the empty drum with the exhausted roll 3 is removed and replaced by a new and full one, which now represents the replacement roll.

We claim:

1. A package producing machine which includes a flying change-over apparatus, comprising:

a main plate movably mounted to said package producing machine;

first and second drums carrying first and second rolls of strip material, said first and second drums being mounted on said main plate;

gluing means for gluing a first strip from said first roll to a second strip from said second roll, said gluing means being mounted on said main plate and including a pair of pressure-applying rollers which are movable relative to each other to press said strips together;

an adjusting drive for moving at least one of said pressure-applying rollers relative to the other of said pressure-applying rollers;

first cutting means mounted on said main plate for cutting said first strip; and control means for controlling said adjusting drive and said first cutting means in response to a position of a first roll size sensing device such that said adjusting drive is driven and said first cutting means is operated when said first roll is nearly depleted.

2. A package producing machine according to claim 1, wherein said first roll size sensing device includes a roll size sensing roller held on a periphery of said first roll, a sensing arm connected to said sensing roller, an articulating block connected to said sensing arm and pivotally mounted on said main plate, a switch, and a switching block carried by said articulating block for actuating said switch when said first roll is nearly depleted.

3. A package producing machine according to claim 2, wherein said switching block is adjustable relative to said articulation block.

4. A package producing machine according to claim 1, further including a plurality of direction changing rollers for guiding said strips, at least one of said direction changing rollers being a first jockey roller.

5. A package producing machine according to claim 4, further including a first brake which is connected to an arm of said first jockey roller and which is engageable with a side plate of one of said first and second drums, said first brake including a V-shaped steel bracket.

6. A package forming machine according to claim 5, further including a second brake which is connected to an arm of a second jockey roller and which is engageable with a side plate of the other of said first and second drums.

7. A package producing machine according to claim 1, further including rotating means for rotating said drums, and a safety device located downstream of said gluing means with respect to movement of said strips for switching off said rotating means.

8. A package producing machine according to claim 7, wherein said safety device includes a switching roller whose weight is supported by one of said strips, a switching arm pivotally mounted on said main plate and on which said switching roller is mounted, a switching lug mounted on said switching arm, and a switch mounted adjacent said switching lug, such that breakage of said strip supporting said roller arm allows said switching lug to drop away from said switch and open a drive circuit of said rotating means.

9. A package producing machine according to claim 1, further including second cutting means mounted on said main plate for cutting said second strip, and a second roll size sensing device for sensing a size of said second roll.

10. A package forming machine according to claim 1, wherein said pair of pressure-applying rollers is arranged symmetrically about a central line which is perpendicular to a line connecting the axes of said first and second rolls.

11. A package producing machine according to claim 1, wherein said main plate is pivotally mounted to said machine.

* * * * *